US005337842A

United States Patent [19]

Robinson

[11] Patent Number: 5,337,842

[45] Date of Patent: Aug. 16, 1994

[54] DRILL STEEL

[76] Inventor: Stanley D. Robinson, R.R. #1 Tower Drive, North Bay, Ontario P1B 8G2, Canada

[21] Appl. No.: 912,419

[22] Filed: Jul. 13, 1992

Related U.S. Application Data

[63] Continuation-in-part of Ser. No. 617,833, Nov. 26, 1990.

[51] Int. Cl.[5] ..... E21B 17/00

[52] U.S. Cl. ..... 175/323

[58] Field of Search ..... 175/19, 323; 76/108.6

[56] References Cited

U.S. PATENT DOCUMENTS

| | | | |
|---|---|---|---|
| 2,533,227 | 12/1950 | Delaney | 76/108.6 |
| 2,733,943 | 2/1956 | Nater | 175/323 |
| 3,117,471 | 1/1964 | O'Connell et al. | 76/108.6 |
| 3,421,351 | 1/1969 | Newman et al. | 72/64 |
| 3,555,935 | 1/1971 | Dorrenberg | 76/108.6 |
| 4,171,634 | 10/1979 | Perkins | 72/299 |
| 4,898,503 | 2/1990 | Barish | 76/108.6 |
| 4,945,999 | 8/1990 | Malzahn | 175/19 |

FOREIGN PATENT DOCUMENTS

| | | |
|---|---|---|
| 0173675 | 5/1986 | European Pat. Off. . |
| 0177467 | 9/1986 | European Pat. Off. . |
| 528626 | 6/1931 | Fed. Rep. of Germany . |
| 3238253 | 5/1983 | Fed. Rep. of Germany . |
| 426511 | 7/1911 | France . |
| 2355581 | 1/1978 | France . |

OTHER PUBLICATIONS

PCT International Search Report and Annex to the International Application No. PCT/CA91/00412.

*Primary Examiner*—William P. Neuder
*Attorney, Agent, or Firm*—Bereskin & Parr

[57] ABSTRACT

A drill steel is provided for use in percussive drilling. The drill steel has an elongate body for transmitting energy between a drill rig and a drill bit, and each end of the drill steel has an end coupling portion. The body has a means for reducing vibrations at the end coupling portions comprising a twisted portion between the two ends. The twisted portion transmits less vibration than untwisted drill steel of corresponding size under the same conditions. The twisted portion also promotes bending in the drill steel in at least two or more places. The twisted portion may have a helical pitch of between one half turn over the length of the drill steel and two turns per foot. The twist may be of uniform or variable pitch, or a combination thereof.

14 Claims, 11 Drawing Sheets

AVERAGE OVER ALL VIBRATION LEVELS FOR EACH ORIENTATION

DRILL STEEL

FIELD OF THE INVENTION

This application is a continuation-in-part of application Ser. No. 617,833 filed on Nov. 26, 1990. This invention relates to a drill steel, and a method of forming a drill steel, and a method of percussive drilling utilising a drill steel.

BACKGROUND OF THE INVENTION

In percussive drilling, energy is transmitted from a rock drill through a drill steel and the drill bit to the rock where the energy is used to perform crushing work.

The rock drill is provided with a piston which is thrown forwards to strike the shank of the drill steel, the energy of the piston passing into the drill steel and through the drill bit in the form of an impact wave.

Conventional drill steels are formed of elongate steel rod, and are often provided with a central throughbore to carry flushing fluid, such as water, air or foam from the drilling rig to the bit to flush out the loosened rock chippings. Drill steels may be of a variety of sizes, typically being between 2 and 22 feet long. Smaller, less substantial drill steels or extensions between a driver and a bit are used in many other industries, notably in the construction industry.

SUMMARY OF THE INVENTION

According to a first aspect of the present invention, there is provided a drill steel for use in percussive drilling comprising an elongate body for transmitting energy between a drill rig and a drill bit and having two ends, each of said ends having an end coupling portion, said elongate body having a means for reducing transmitted vibration comprising a twisted portion between said two ends, said twisted portion transmitting less vibration than an untwisted drill steel of corresponding size under the same conditions.

According to a second aspect of the present invention, there is provided a method of percussive drilling comprising procuring a drill steel having an elongate body and two ends with end coupling portions for transmitting energy between a drill rig and a drill bit and having a twisted portion in said elongate body, mounting said twisted drill steel in between the drill rig and a drill bit by inserting said end coupling portions into connectors, and energizing said drill rig to transmit energy through said twisted drill steel by rotating and impacting said twisted drill steel, wherein said twisted portion of said drill steel transmits less vibration than an untwisted drill steel of comparable size to reduce wear on said connectors.

Preferably, the twist is applied along a substantial length of the drill steel and most preferably, along at least 30% of the length of the drill steel.

The twisted drill steel exhibits improved longevity when compared to a conventional, untwisted drill steel of corresponding size. Further, it has been found that vibration at the drill bit and at the drill rig chuck or coupling is reduced when using a twisted drill steel in place of a conventional, untwisted drill steel. The reduction in vibration facilitates handling of the drill, reduces energy losses and decreases wear and damage to the drill coupling components.

BRIEF DESCRIPTION OF THE DRAWINGS

These and other aspects of the invention will now be described, by way of example, with reference to the accompanying drawings, in which.

DETAILED DESCRIPTION OF PREFERRED EMBODIMENTS

Figure 1:
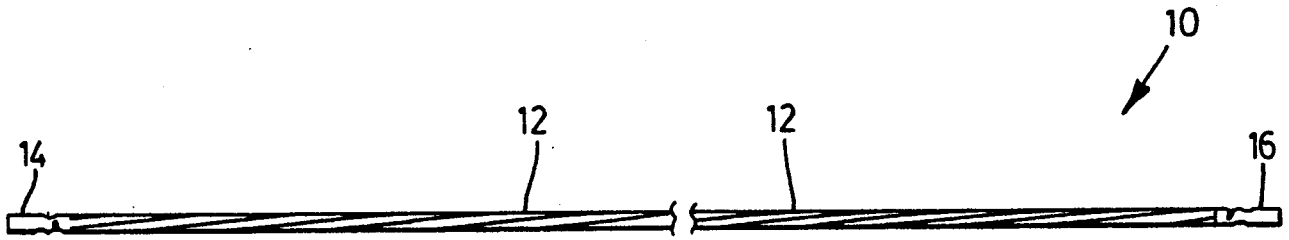
FIG. 1 shows a drill steel in accordance with a preferred embodiment of the present invention.

The present invention relates to a percussive drill steel provided with a twist along a substantial portion thereof, and a method of forming such a drill steel. Reference is first made to FIG. 1 of the drawings which illustrates a drill steel in accordance with a preferred embodiment of the present invention. The drill steel, generally indicated at 10, is an elongate rod having an intermediate twisted portion 12 and two end coupling portions 14, 16 for connection to a drill rig coupling and drill bit, respectively. In this particular example, the drill steel 10 is formed of a 12′ length of 1.⅛″ diameter hexagon cross-section steel. The twisted portion 12 may have a helical pitch 12 ranging between one that is "loose" (i.e. ½ turn over the length of the drill steel) to one that is "tight" (i.e. 2 turns per foot). A preferred embodiment of the drill steel 10 has a twisted portion 12 with a uniform helical pitch, and a most preferred embodiment has a twist of variable pitch. Good results have been achieved using a twisted portion 12 having a helical pitch which decreases from 41″ adjacent the rig coupling portion 14 to 36″ adjacent the bit coupling portion 16. The coupling portions 14, 16 in the illustrated example are in the form of a 1.¼" rope thread coupling portion 14 and a 1.⅛" rope bit thread coupling portion 16, the thread being formed after the plain drill steel was twisted over its length.

Figure 2:
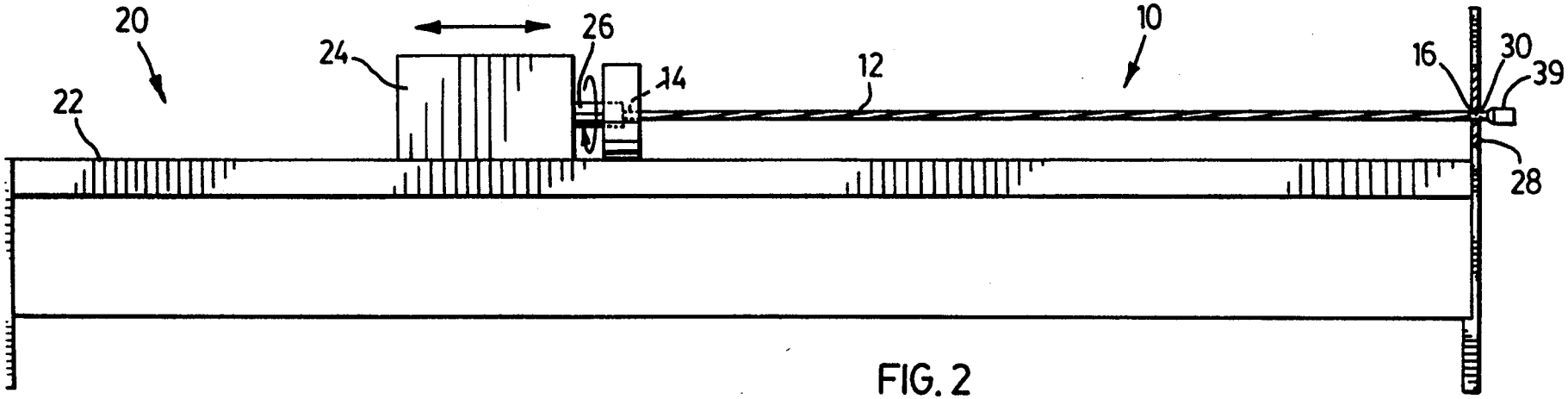
FIG. 2 shows a machine tool for producing the drill steel of FIG. 1.

Reference is now also made to FIG. 2 of the drawings, which illustrates the machine 20 which is used to apply the twist to the steel. Mounted on the machine bed 22 is a longitudinally moveable carriage 24 provided with a rotatable chuck 26 for gripping one end of the steel 10. In order to assure that the steel is held firmly by the chuck 26, it may be necessary to machine or forge a chuck connection at the end of the steel. The connection could be in the form of a thread, collar or any other appropriate connection.

Figure 3:
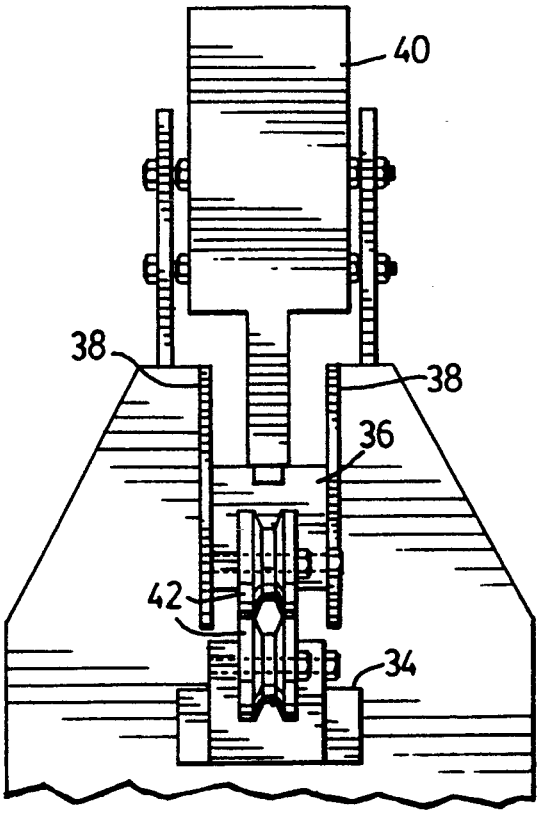
FIG. 3 is an enlarged end view of the clamp, indicated 30 area of the machine tool of FIG. 2.

The intermediate portion of the steel 10 extends through a clamping device 28 provided with a clamp 30 suited to the drill steel 10 being twisted, in this case a hexagonal clamp 30, in the form of rollers 42 (FIG. 3) of complementary diameter to the untwisted intermediate portion. The clamping device is illustrated in greater detail in FIG. 3 of the drawings, and comprises a frame 32, a lower, fixed roller assembly 34, and an upper, moveable roller assembly 36, which is mounted in vertical guides 38. The clamping force for the movable force roller assembly is provided by a hydraulic clamping cylinder 40.

An induction coil 39 (FIG. 2) is provided adjacent the clamping device and is used to heat the steel prior to twisting.

At the start of the twisting operation, the carriage 24 is positioned adjacent the clamp 30 and then is moved longitudinally along the bed 22, away from the clamp 30 (towards the left as seen in FIG. 2), while the chuck 26 is rotated. The intermediate portion 12 of the steel 10 passes through the induction coil to be heated and then passes through the clamp 30, which does not allow rotation of the part of the portion 12 within the clamp 30. Accordingly, the portion is twisted as it leaves the clamp. The operation is continued, with the longitudinal feed and rotation of the chuck 26 being maintained at predetermined rates to provide a desired pitch, varying or uniform, until all of the intermediate portion 12 has passed through the clamp 30. This is the position shown in FIG. 2.

If the machine 20 and drill steel permit, the twisting process may be performed when the steel is cold, but is more likely to be carried out when the steel is warm or hot, with feed and rotation speeds being varied accordingly, as will be obvious to a person skilled in the art. In this particular example, the drill steel was heated to 1550° F. to 1600° F. and mounted on the machine 20 set for longitudinal feed of 38 inches per minute (ipm) and chuck rotation of 0.83 rpm.

Following twisting, the drill steel is machined to form the thread on coupling portions 14, 16 and is then subjected to further hardening, by overall gas carburizing or by induction hardening.

To demonstrate the improved qualities of a twisted drill steel compared to a conventional non-twisted drill steel, two twisted drill steels, as described above, were used alongside two conventional untwisted drill steels of similar dimensions and specifications.

The drill steels were fitted to a Pneumatic 3-Boom Jumbo Drill Rig, commonly referred to in the mining industry as a "Jumbo". The drill rig is capable of drilling three holes at the one time and provides rotation together with a percussive force. The particular rig used operates at a rotation of 172 rpm with 100 psi air pressure and a percussive feed of 60 psi.

Figure 4:
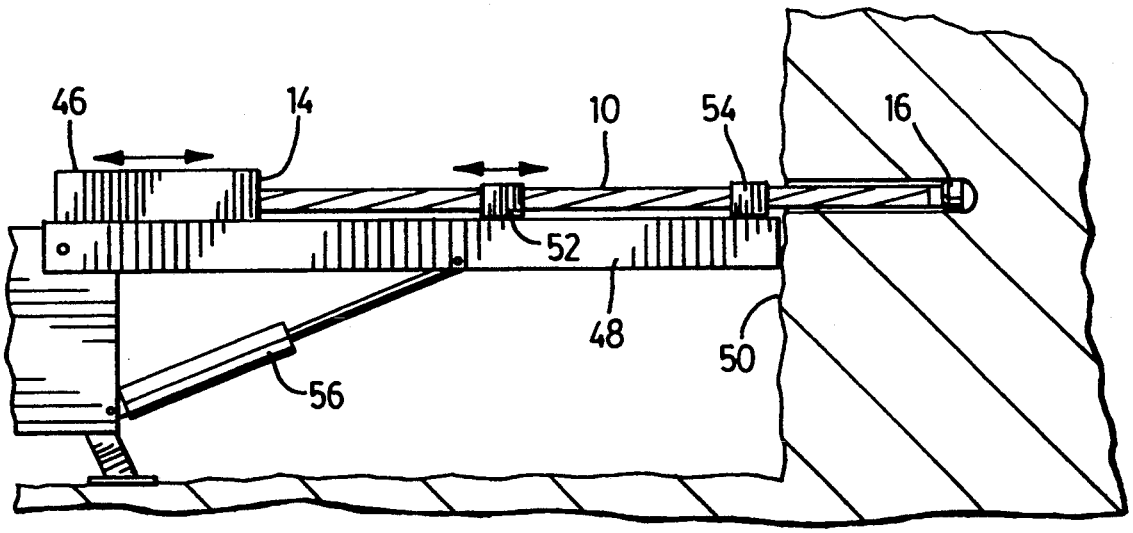
FIG. 4 is a schematic representation of a drill rig utilising a drill steel.

To facilitate understanding of the drilling operations, FIG. 4 for the drawings illustrates, somewhat schematically, a drilling rig provided with a drill steel 10, engaged in a drilling operation. The FIGURE is not intended to accurately represent any specific drill rig. The drill rig coupling portion 14 is mounted in a cradle 46 which runs along a feed beam 48 which is braced firmly against the rock face 50. The feed force is mechanically transferred to the cradle by chain or screw. A rotation motor is provided on the cradle 46 as is the percussive drive. The drill steel 10 is supported along its length by a travelling centraliser 52 and a collar 54 fixed to the end of the feed beam 48.

The inclination of the feed beam 48 is controlled by a hydraulic lifter 56 which extends from the rig to a mid point of the beam.

In testing, the drilling rig was fitted with the drill steels and used to drill wall slashes, flat drifting and down ramps in hard waste (30,000 psi) and soft ore (22,000 psi).

The first of the twisted drill steels drilled 3,793 feet before breaking 30" from the bit thread coupling portion 16. While in use, the drill steel was bent on two occasions but was straightened and continued to be used. The second twisted drill steel provided 4,250 feet of drilling before the rope thread at the drill rig coupling portion 12 wore out. This drill steel was also bent at one point and straightened and put back in use.

Both untwisted drill steels broke at the drilling rig coupling portion, one drill steel after 756 feet of drilling, and the other drill steel after 608 feet of drilling.

During drilling, it was observed that there was no significant difference in penetration rates between the twisted and non-twisted drill steels, and hole deviation was much the same for both forms of drill steel. The removal of sludge (broken rock and flushing fluid) from the drilled holes was also substantially similar though the twisted portions slowed the sludge as it left the hole such that the hydraulic lifters on the drill rig were kept cleaner than the lifters being used with the rig provided with conventional steels. It is also believed that the auger action of the twisted drill steel would provide improved penetration rates and better sludge removal where the sludge is particularly viscous.

Figure 5A:
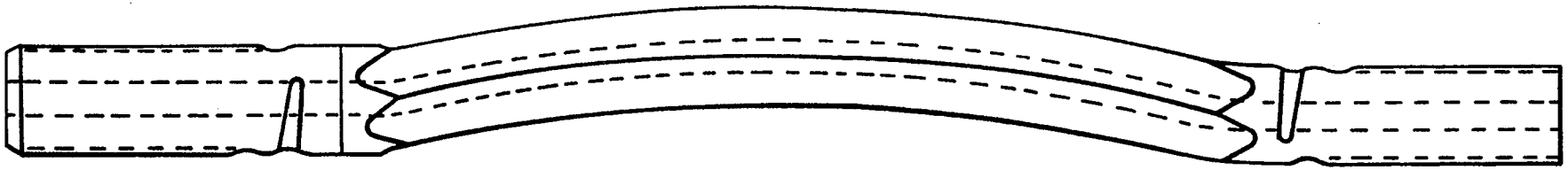
FIG. 5a (PRIOR ART)
FIGS. 5A and 5B illustrate, somewhat exaggerated, the deformation characteristics of a prior art drill steel and a drill steel in accordance with the present invention, respectively, under difficult drilling conditions.

Under difficult drilling conditions, when too high a feed was used in hard rock, the conventional drill steels bent in a single bend between the bit coupling portion and the drilling rig coupling portion, as illustrated in FIG. 5A of the drawings. The particular bending illustrated would occur, for example, when the drill steel was "collared", that is, the bit held in position while starting a hole. Under these conditions, heat was generated at the drill bit threaded coupling portion, and this condition leads to premature breakage of the coupling portion. When collaring, the intermediate portion of the drill steel was supported by a travelling centralizer, and under similar conditions the twisted drill steels appeared to bend from the bit coupling portion though the bend only appeared to extend as far as the centralizer and did not affect the rig coupling portion.

Figure 5B:
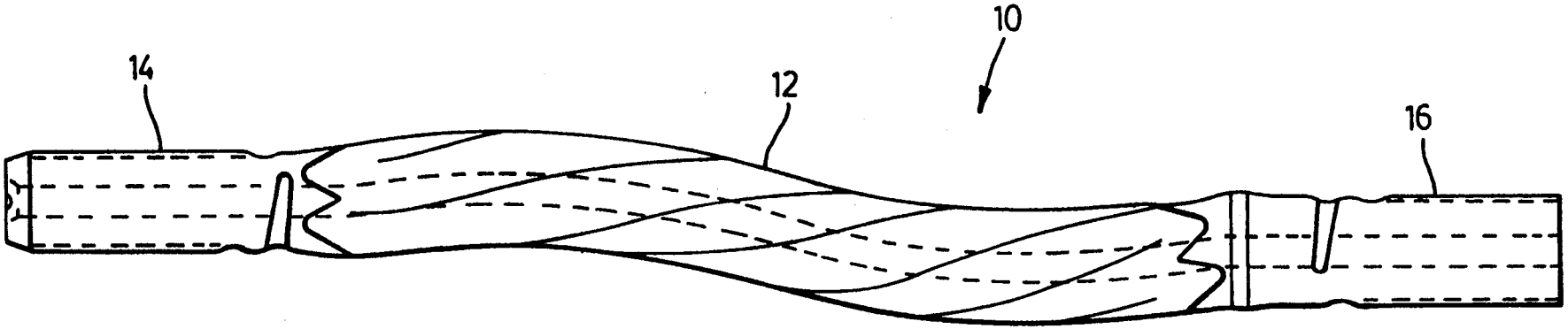

Even when the twisted drill steels were elastically deformed over their length, the bend appeared as a "wave" of two or more bends, similar to the second or subsequent modes of vibration, as may be seen in FIG. 5B of the drawings. As the misalignment of the coupling portions is reduced when the deformation takes this form, as opposed to the single bend, wear and damage to the coupling portions is reduced.

A further noticeable difference when using the twisted drill steels was that the vibration reaching the drill rig was substantially lower than the vibration experienced under similar conditions when using a conventional drill steel. The vibration represents the "echo" shock waves returning up the length of the steel, the shock waves being produced by the portion of the percussive energy that is not utilised at the drill bit. The reduction in vibration serves to prolong the life of the coupling components of the drill rig, such as couplings, striking bars and chuck bushings, in addition to prolonging the life of the drill steel, and would reduce the necessity for vibration or shock absorbing features on the rig. In smaller, hand-held rigs such a reduction in vibration would also facilitate the use of the equipment and would reduce the likelihood of the operator suffering from "white hand", a circulation problem associated with the prolonged use of vibrating, hand-held machinery. The circulation problem is also referred to as Hand Arm Vibration (HAV) Syndrome or Vibration-induced White Finger (VWF).

EXAMPLE 1

A study was conducted at Laurentian University in Ontario, Canada to monitor vibration levels transmitted to the hands of an operator of a Jackleg drill and the effect of spiral, or twisted, hexagonal ("hex") drill steels according to the present invention in reducing such vibration levels. The tests were conducted on both conventional, i.e. untwisted, drill steels and twisted drill steels as described above, namely having a helical pitch which decreases from 41 in. adjacent the rig coupling portion to 36 in. adjacent the bit coupling portion.

Figure 6:
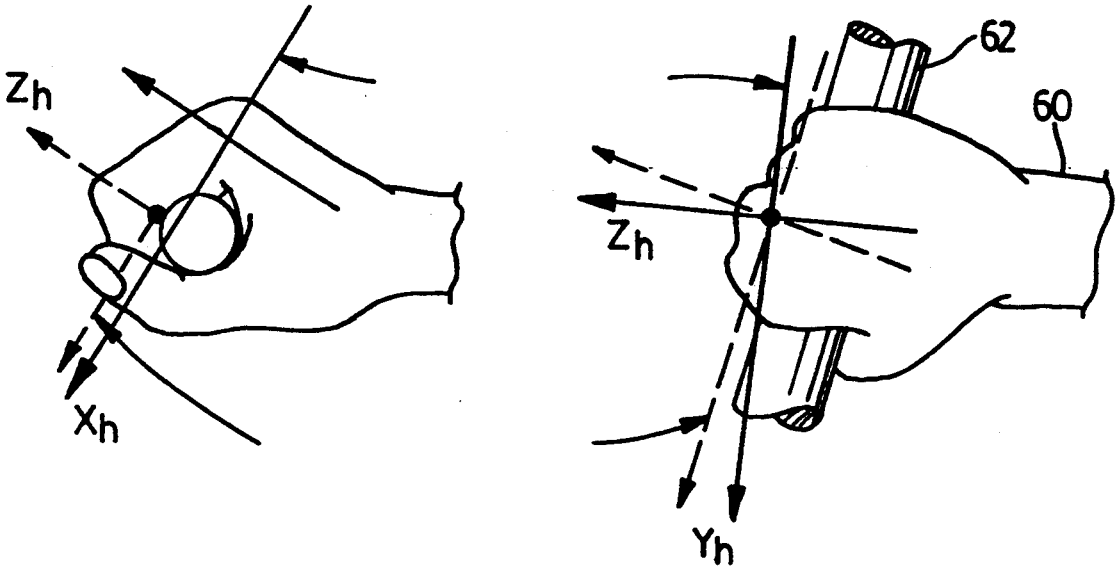
FIG. 6 shows an orthogonal coordinate system superimposed on a hand of a user (in top and side view) gripping a handle of a Jackleg drill in a study conducted at Laurentian University.

Since vibration is a vector quantity, vibration was measured in three orthogonal directions, namely $X_h$, $Y_h$ and $Z_h$ as shown in FIG. 6. FIG. 6 shows a hand 60 of a user gripping a handle 62 of the jackleg drill. Vibration acceleration at the handle 62 can be expressed in m/sec$^2$ or in terms of decibels (dB) using $10^{-6}$ m/sec$^2$ as a reference according to the following equation:

$$L = 20\log\left(\frac{a}{a_r}\right)$$

where

L=acceleration level a=measured acceleration in m/sec$^2$ $a_r$=reference acceleration, $10^{-6}$ m/sec$^2$ A new Secan S250 TM Jackleg drill produced by Boart Canada Inc. was used in the study to bore into ordinary Sudbury hard rock medium (consisting mainly of norite rock). The drill was operated at full air pressure of 110 psi and at full water pressure of 50 psi, although vibration measurements were taken between half and full throttle following a pre-set sequence of steps. Firstly, grit was flushed out of the drill holes. Then the drill operator would increase the drill feed rate to increase resistance on the drill and thereby decrease its engine speed to a predetermined operating level for taking the vibration measurements. Ten measurements (each measurement consisting of a 20 second "trace") were taken for each of the twisted and untwisted drill steels in each of the three orthogonal directions with the engine operating at the predetermined level. The measurements were taken with a Bruel & KJaer uni-axial accelerometer weighing 17 grams and having lower and upper frequency limits of 0.1Hz and 10.0 kHz respectively.

Figure 7:
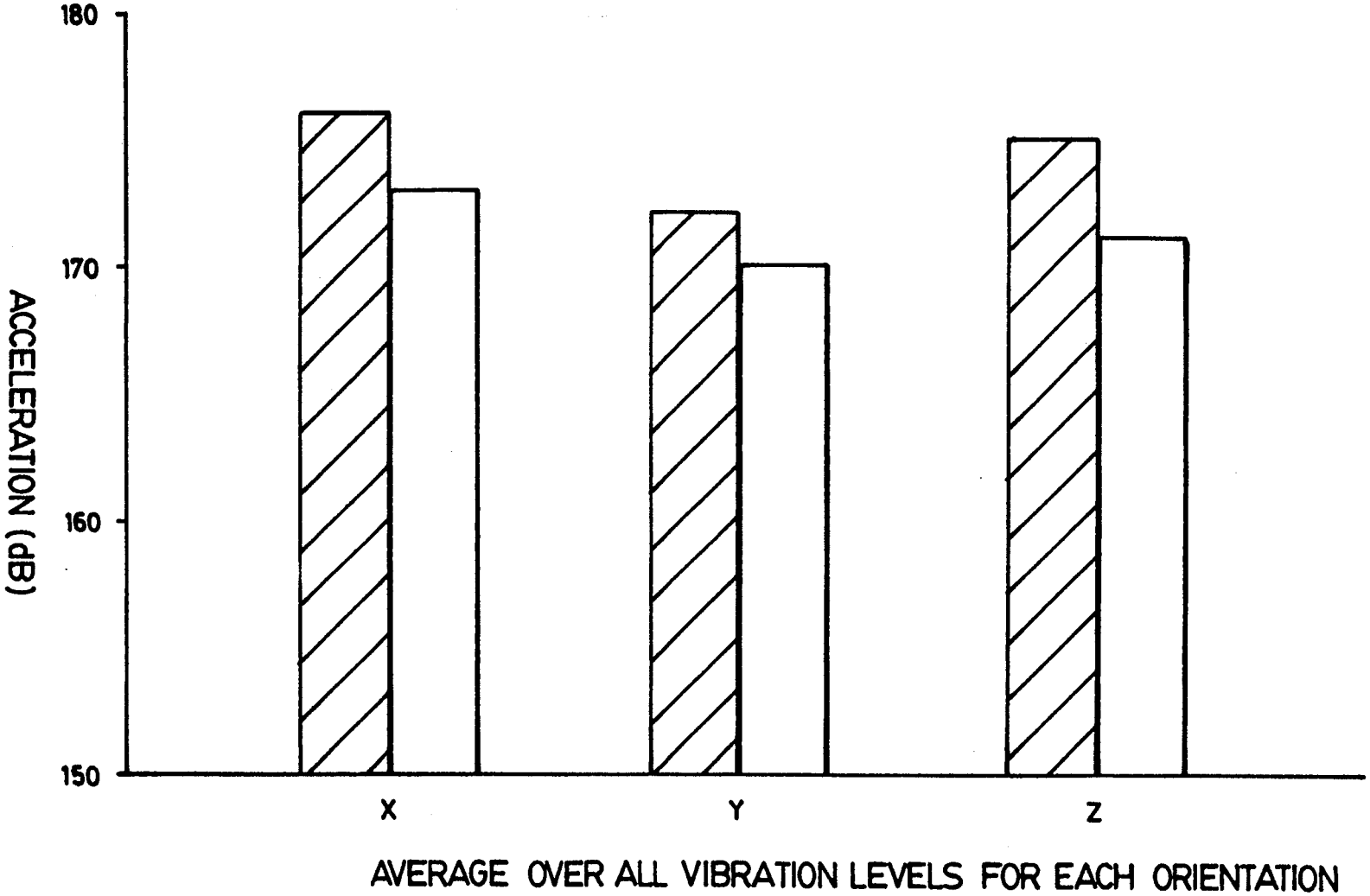
FIG. 7 is a bar graph of overall vibration levels for an untwisted hexagonal drill steel and a twisted hexagonal drill steel according to the present invention in three orthogonal directions at said hand of FIG. 6.

FIG. 7 shows the level of acceleration measured at the handle 62 in each of the three orthogonal directions during drilling operations using a regular, or conventional (ie. untwisted), hex drill steel (shaded bar graph) and the twisted hex drill steel (unshaded bar graph). For each coordinate direction, namely in the X, Y and Z directions, the twisted drill steel consistently produced lower overall vibration levels, namely 3dB, 2dB and 4dB for the $X_h$, $Y_h$ and $Z_h$ directions respectively. The results translate into a reduction of transmitted vibrations by 30%, 20% and 37% in the $X_h$, $Y_h$ and $Z_h$ directions respectively. Hence, the overall vibration level transmitted to the handle 62 from the twisted drill steel in the three orthogonal directions is reduced on average by about 25% over that of the conventional untwisted drill steel. This is a significant improvement in performance of twisted drill steels over conventional drill steels.

Figure 8:
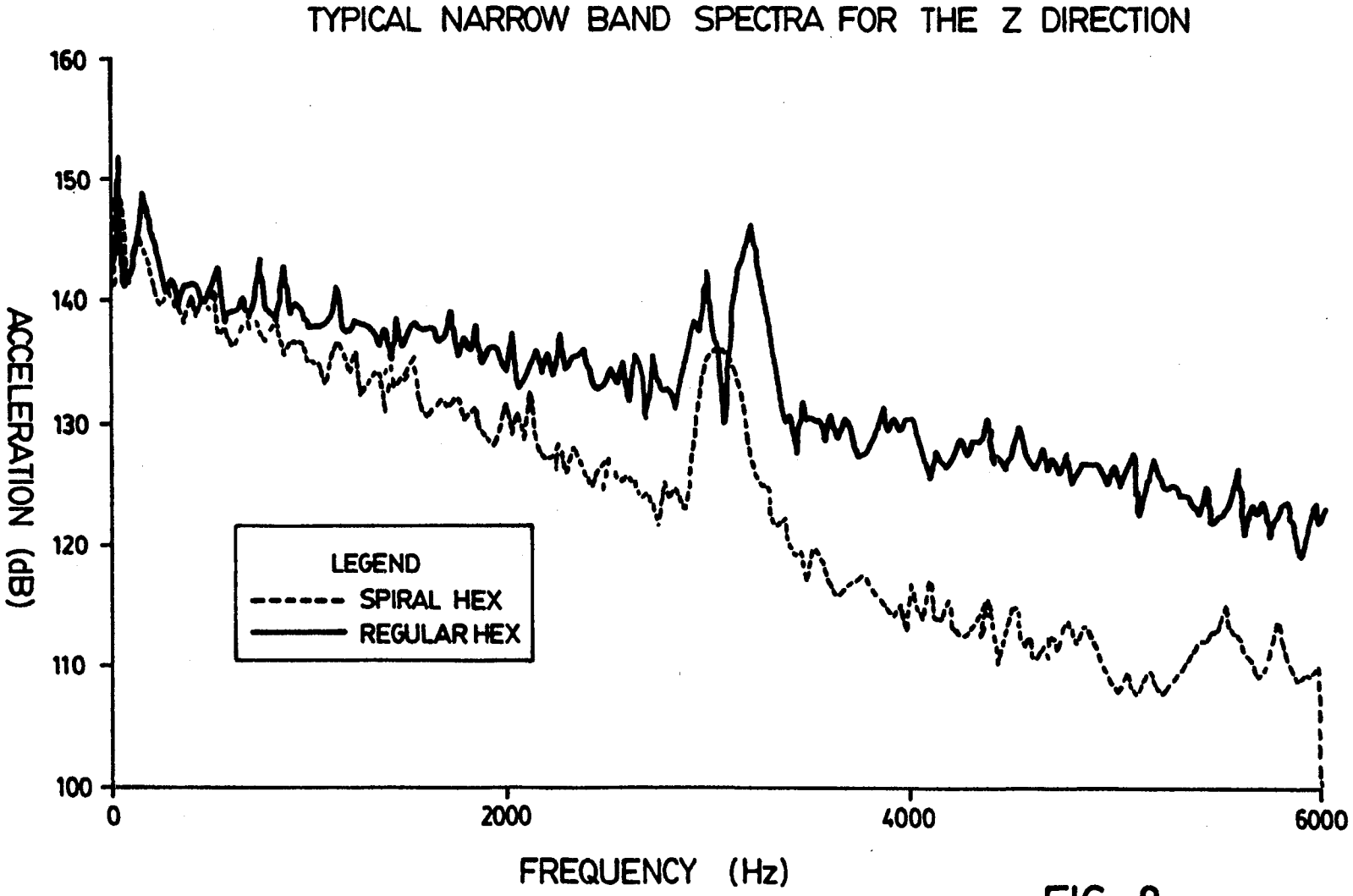
FIG. 8 shows the overall vibration levels of FIG. 7 in one of the orthogonal directions over a range of frequencies.

The acceleration levels of the drill steels was also measured over a range of narrow band vibration frequencies from 0 to 6000 Hz. FIG. 8 illustrates a typical narrow band spectra for the conventional and twisted drill steels in the $Z_h$ direction. It is believed that the $Z_h$ orientation represents the clearest indication of vibration levels. The results for each of the three directions indicate that the reduction in the overall vibration levels presented above for the twisted drill steel occurs for "higher" frequency components of vibration. Generally, the reduction in the overall vibration levels in the three orthogonal directions occurs above 500 Hz, with a slight reduction at about 60 Hz. It is noted that the large peaks in acceleration at about 25 Hz (fundamental frequency) and 70 Hz (second harmonic frequency) are a consequence of the hammering frequency of the rock drill in the testing program. The peak at about 3000 Hz is unexplained.

EXAMPLE II

Figure 9:
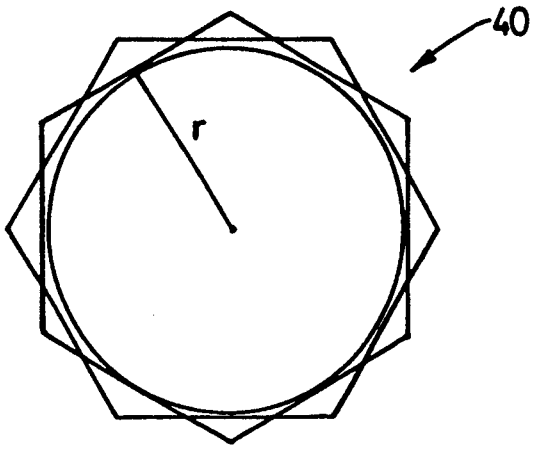
FIG. 9 shows two superimposed cross sections through a twisted hexagonal drill steel according to the present invention which was used in additional tests conducted at Laurentian University.
Figure 10:
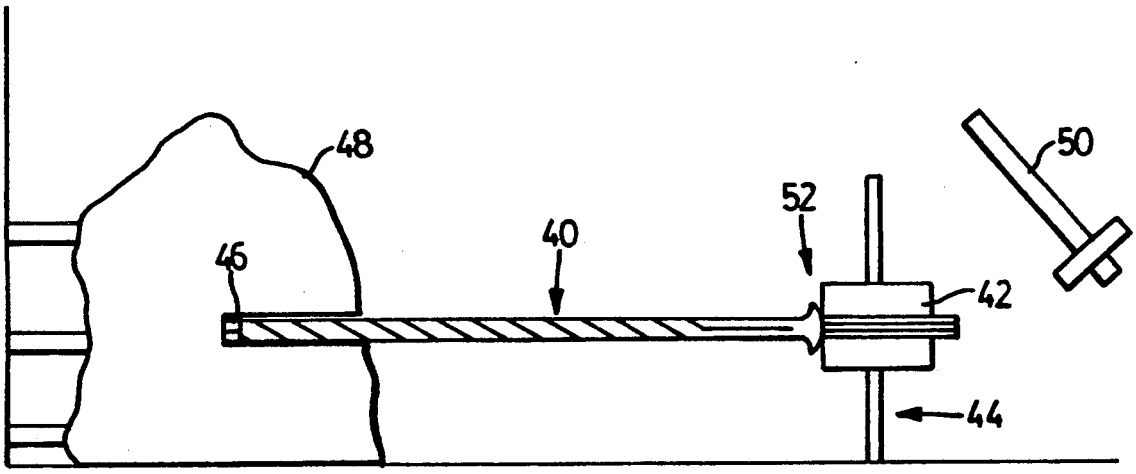
FIG. 10 shows the laboratory set-up, including the drills steel of FIG. 9, for the additional tests.

Additional tests investigated longitudinal and bending (ie. transverse) waves generated in drill steels under percussive impacts. The response of conventional hex drill steels was compared to twisted hex drill steels. Each twisted drill steel 40 in the tests had a diameter of $\frac{7}{8}$ inch (2.22 cm) and a length of 6 feet (182.9 cm). The drill steel 40 had a twist as described above, namely a helical pitch which decreases from 41 in. adjacent the rig coupling portion to 36 in. adjacent the bit coupling portion. Two cross sections of the twisted drill steel 40 at different locations along its length are shown, superimposed, in FIG. 9. The laboratory set-up for the tests is shown in FIG. 10. Each drill steel 40 was mounted at one end in a chuck 42 which was secured by a sturdy clamp 44. A new carbide drill bit 46 was mounted on the other end of the drill steel 40 to impact with a braced norite rock 48. Appropriate weights were added to a pendulum hammer 50 to impart sufficient energy to the drill steel 40.

Each impact of the drill steel delivers a quantity, or "package", of energyto the drill steel. The drill steel 40 then transmits the package to the drill bit 46 at a high stress level for a short time period or at a lower stress level for a longer period (ie. termed shorter and longer impact stress pulses, respectively). The energy transmitted to the bit is determined by the stress waveform generated by impacting the drill steel 40. The control and design of the waveform affects rock penetration and the life of the drill steel. Ideally, energy delivered to the bit is totally consumed at the bit-rock interface. In practise, however, energy is reflected back from the bit into the drill steel towards the struck end in the form of a reflected pulse. The impact stress pulses tend to be compressive and the reflected stress pulses tend to be tensile.

Figure 11:
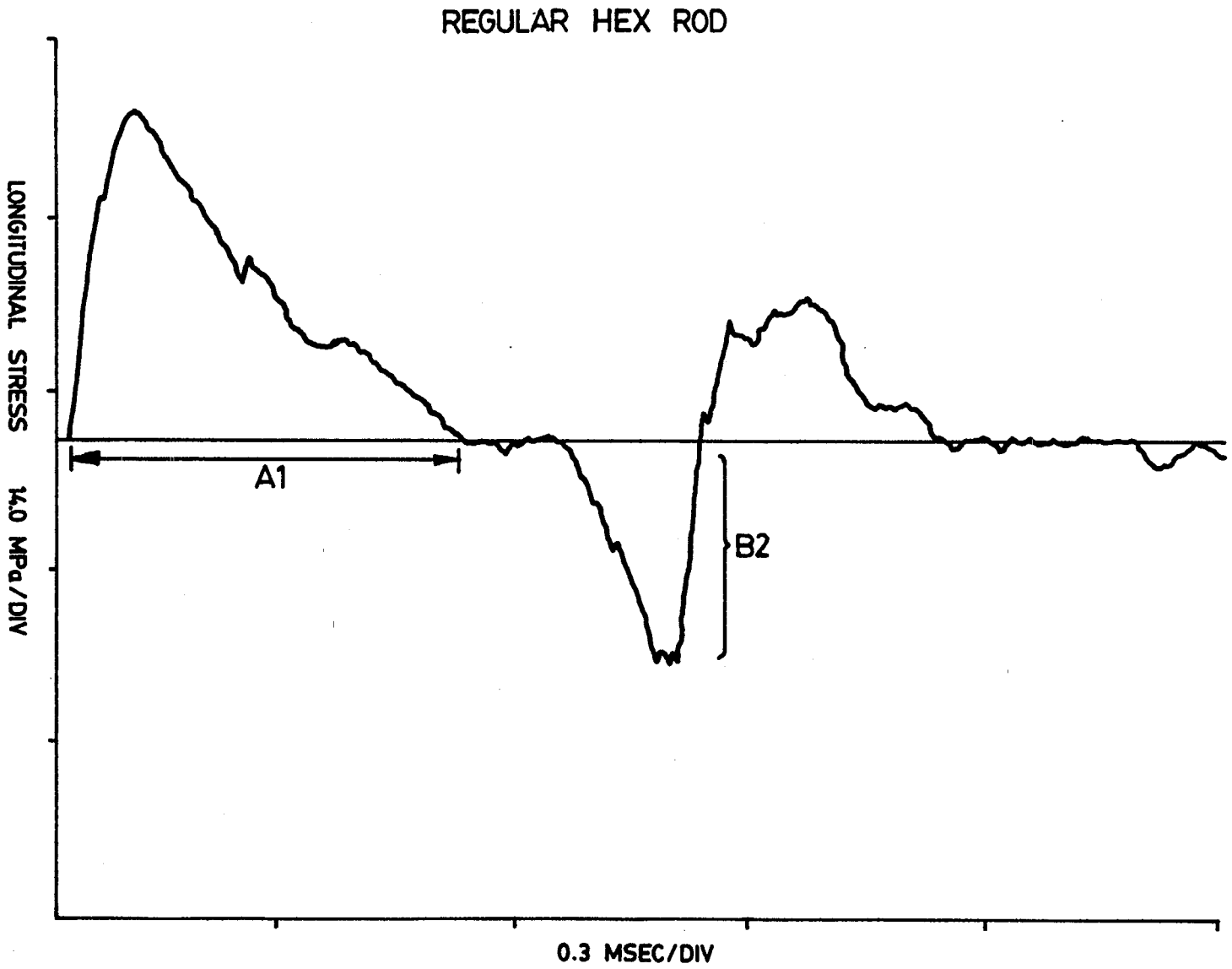
FIG. 11 is a graph of longitudinal stresses produced in an untwisted hexagonal drill steel v. time according to the additional tests.
Figure 12:
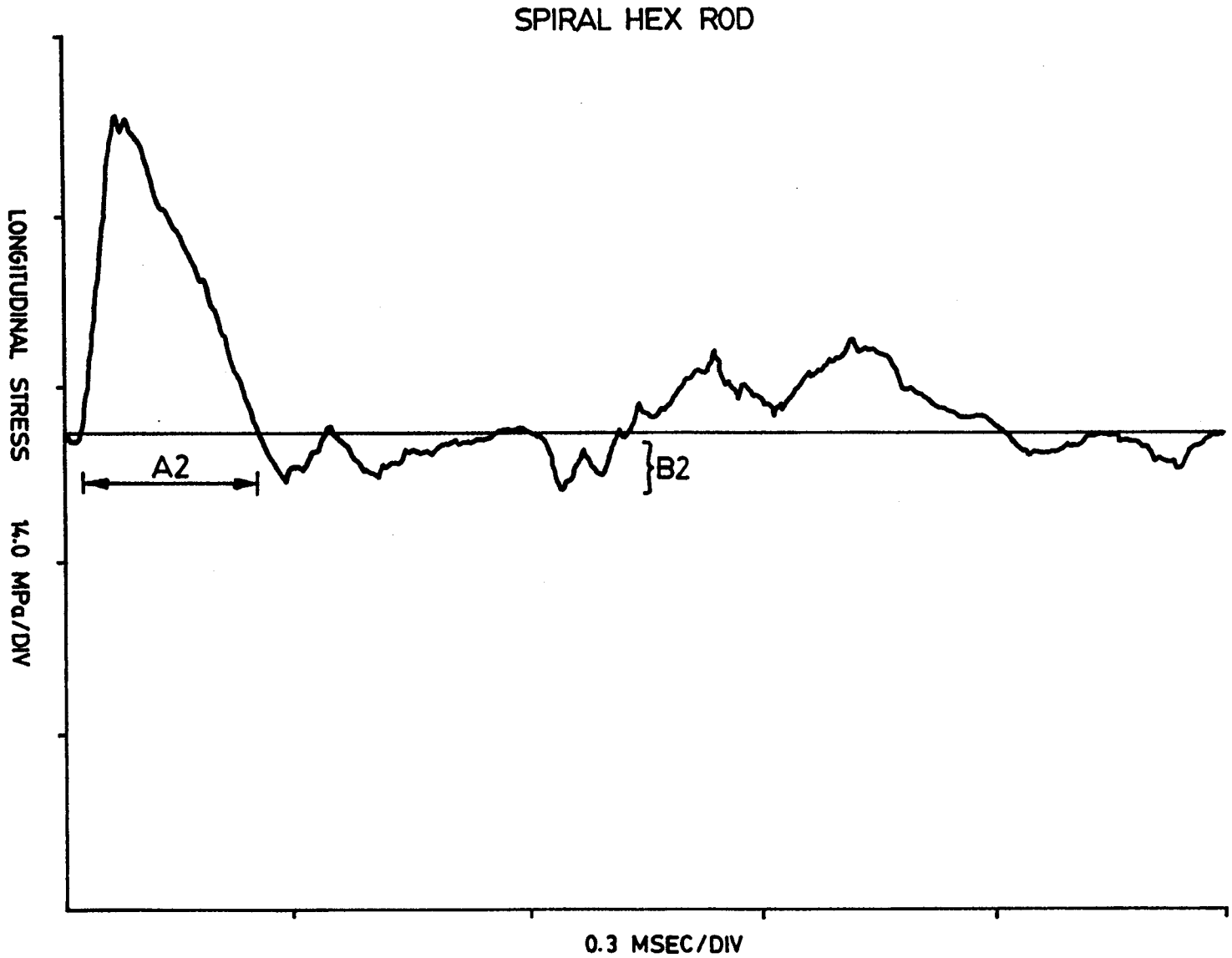
FIG. 12 is a graph similar to that of FIG. 11, but using the twisted drill steel of FIG. 9.

FIGS. 11 and 12 show the resultant longitudinal stresses, or waveforms, for the conventional and twisted hex drill steels, respectively. The spiral drill steels transmitted an impact stress pulse (indicated by A2) of shorter duration than that of the conventional drill steels (indicated by A1). The magnitude of the reflected stress pulse B2 for the twisted drill steels was also less than that of the conventional drill steels (B1). The study concludes from these test results that the twisted drill steels can withstand considerably more piston impact and have a longer operational lifespan than comparable conventional drill steels.

Figure 13:
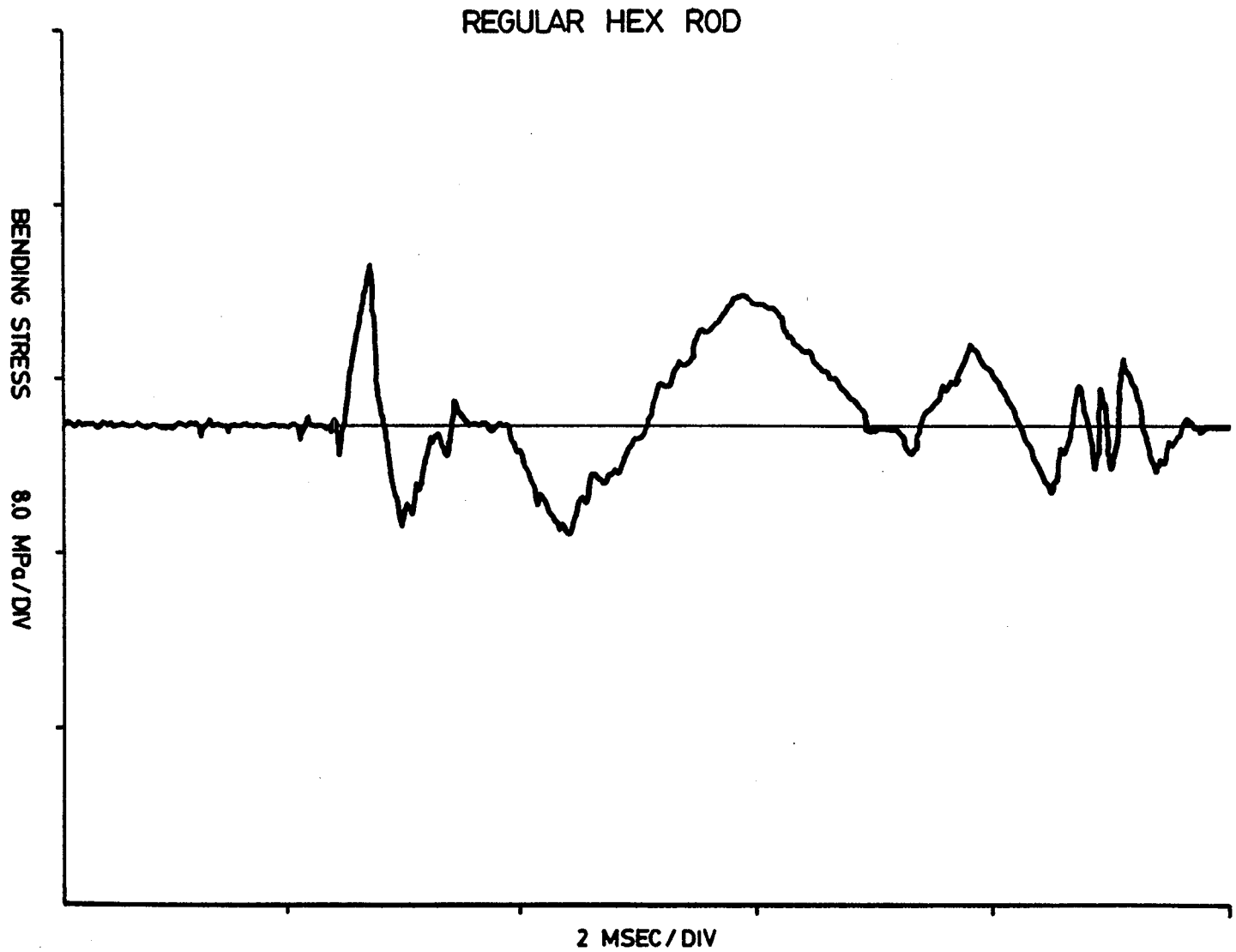
FIG. 13 is a graph of bending stresses produced in an untwisted hexagonal drill steel v. time according to the additional tests.
Figure 14:
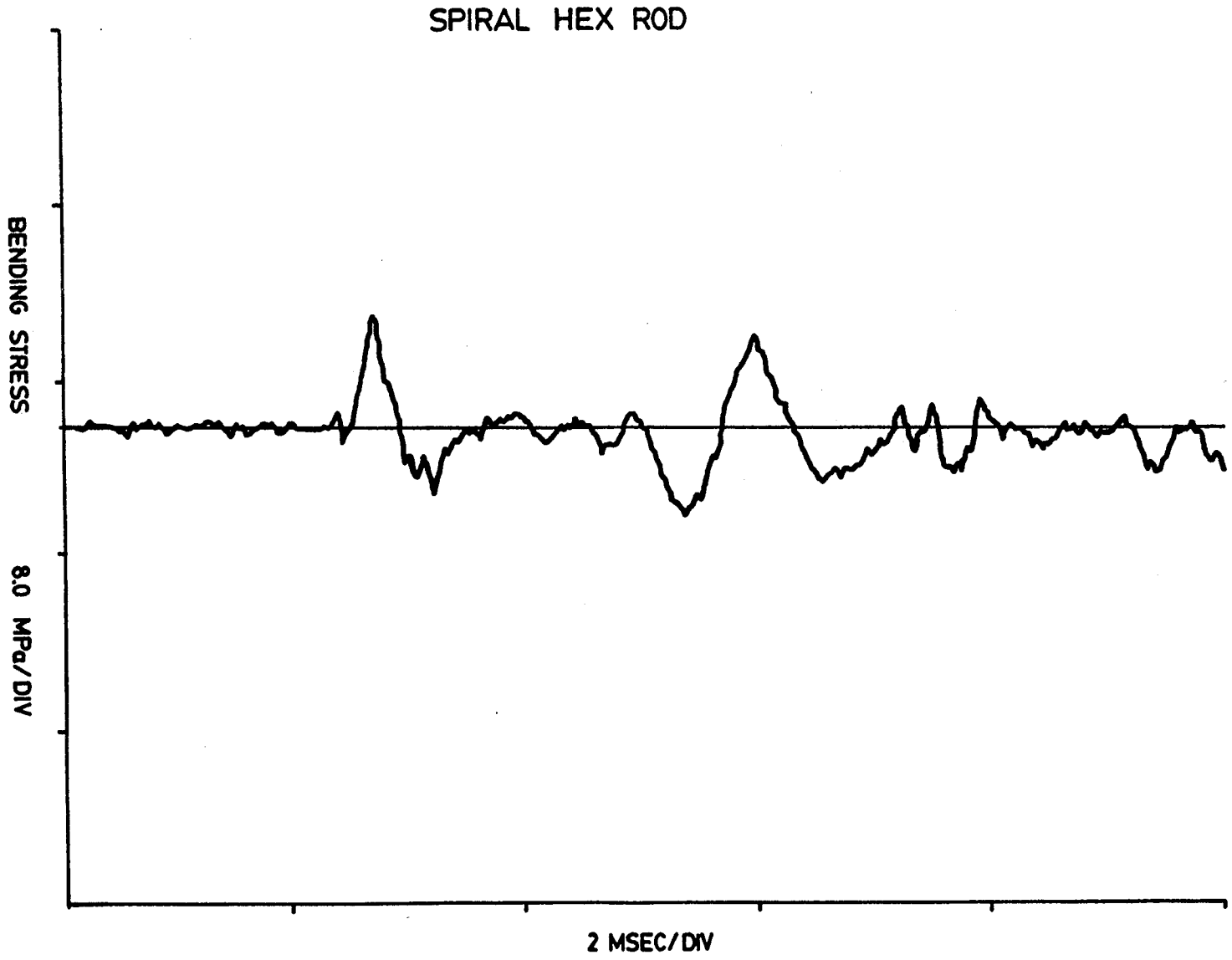
FIG. 14 is a graph similar to that of FIG. 13, but using the twisted drill steel of FIG. 9.

FIGS. 13 and 14 illustrate the resultant stresses due to bending, or flexing, transverse to the axes of the conventional and twisted drill steels, respectively. Bending stresses result from off centered piston impacts, worn chucks and drill steel ends, and bent drill steels. Whereas longitudinal stresses or waves transmit impact forces from the piston to the bit, bending stresses or waves do not contribute to the drilling rate and serve no useful purpose. It has been observed that the bending stresses of greatest magnitude occur near the shank 52 of the drill steel 40 and at the bit 46, and so contribute to premature thread wear, metal fatigue and breakage at these locations. The results in FIGS. 13 and 14 show that bending stresses are reduced in the twisted drill steel as compared to those in the conventional drill steel, and therefore there is a reduction in the occurrence of premature thread wear and breakage in the twisted drill steel.

Bending waves also contribute to the noise generation of a drill steel. During testing, it was found that noise levels from manual hammer impacts on twisted drill steels were lower than those of the conventional drill steels. As well, the noise generated by the twisted drill steel was distinctly different than that generated by the conventional drill steel.

The superior performance of the twisted drill steel over the conventional drill steel in the Laurentian University tests is attributed mainly to the twisted configuration of the drill steels, and some of the improved performance may be attributed to internal stresses introduced into the twisted drill steels when the spiral configuration of the twisted drill steels is formed.

During the tests the spiral configuration of the twisted drill steels also provided better removal of sludge from the drill hole as compared to the conventional drill steels. As a result, there is less dampening of longitudinal impact stress pulses by the remaining sludge when using twisted drill steels.

Although the drill steels described above are of relatively large dimensions and are described with reference to the mining and construction industries, drill steels of different dimensions, forms and for different applications could benefit from the advantages described above which are obtained through use of the present invention.

It will be obvious to those skilled in the art that the above-described example is merely for purposes of illustration, and that various modifications and improvements may be made within the scope of the present invention.

I claim:

1. A drill steel for use in percussive drilling, said drill steel comprising:

an elongate body for transmitting energy between a drill rig and a drill bit and having two ends, each of said ends having a separate untwisted end coupling means, said elongate body having a means for reducing transmitted vibration comprising a twisted portion between said separate untwisted end coupling means, said twisted portion having a twist with a helical pitch of between one half turn over the length of the drill steel and two turns per foot, said twisted portion transmitting less vibration than an untwisted drill steel of corresponding size under the same conditions.

2. The drill steel of claim 1 wherein said twisted portion has a twist of variable pitch.

3. The drill steel of claim 2 wherein said variable pitch decreases from said drill rig end toward said drill bit end.

4. The drill steel of claim 2 or 3 wherein said twisted portion has a helical pitch which decreases from about 41 inches between each turn adjacent said end coupling portion closest to said drill rig to about 36 inches between each turn adjacent the other end coupling portion.

5. A drill steel as claimed in claim 1 further including a means to promote bending in said drill steel in at least two or more places comprising a twisted portion between said ends extending substantially along the length of said elongate body between said ends.

6. A method of percussive drilling comprising:

procuring a drill steel having an elongate body and two ends with separate untwisted end coupling means for transmitting energy between a drill rig and a drill bit, said elongate body having a twisted portion with a twist between said end coupling portions with a helical pitch of between one half turn over the length of the drill steel and two turns per foot, mounting said twisted drill steel in between the drill rig and a drill bit by inserting said end coupling portions into connectors, and energizing said drill rig to transmit energy through said twisted drill steel by rotating and impacting said twisted drill steel, wherein said twisted portion of said drill steel transmits less vibration than an untwisted drill steel of comparable size to reduce wear on said connectors.

7. The method of claim 6 wherein said overall vibration level in the direction of the longitudinal axis of the drill steel is reduced up to 30%.

8. The method of claim 6 wherein said overall vibration level in the direction of a transverse axis of the drill steel is reduced up to 37%.

9. The drill steel of claim 6, 7 or 8 wherein said reduction in overall vibration levels occurs at frequencies above 500 Hz.

10. The drill steel of claim 6, 7 or 8 wherein said reduction in overall vibration levels occurs at a frequency of about 60 Hz.

11. A drill steel for transmitting energy between a drill rig and a drill bit comprising:

two ends;

an intermediate segment between said two ends, at least a portion of the length of said intermediate segment being twisted to form a helix, said twisted portion having a twist of variable pitch of between one half turn over the length of the drill steel and two turns per foot and said twisted portion being of sufficient length to promote bending in at least two or more places along said drill steel;

said ends having separate untwisted coupling means, to enable said ends to be coupled to bits, rigs, or other drill steels;

in use in a bore hole in percussive drilling, the drill steel bending in two or more places to reduce misalignment of said ends under a percussive impact, to reduce wear or damage to the drill coupling means, to reduce vibrations at said ends and to increase the longevity of the drill steel as compared to use of a conventional, untwisted drill steel of corresponding size.

12. The drill steel of claim 11, wherein the twist extends along at least 30% of the length of the drill steel.

13. A drill steel of claim 12, wherein in use the longevity of the drill is increased at least three-fold over an untwisted drill steel of corresponding size.

14. A drill steel of claim 13, wherein noise levels are reduced.

* * * * *